United States Patent [19]

Hoza, III

[11] 4,206,877

[45] Jun. 10, 1980

[54] WATER MIST GENERATOR

[76] Inventor: Philip J. Hoza, III, 688 Cherry St., Winnetka, Ill. 60093

[21] Appl. No.: 820,231

[22] Filed: Jul. 29, 1977

[51] Int. Cl.[2] ..... B05B 1/26; B05B 1/30

[52] U.S. Cl. ..... 239/524; 239/569

[58] Field of Search ..... 239/289, 523, 524, 598, 239/521, 518, 569

[56] References Cited

U.S. PATENT DOCUMENTS

| | | | |
|---|---|---|---|
| 1,349,874 | 8/1920 | Coles | 239/523 |
| 1,766,126 | 6/1930 | Johnson | 239/598 |
| 1,954,863 | 4/1934 | Coles et al. | 239/598 X |
| 2,896,865 | 7/1959 | Hamilton | 239/521 |
| 3,085,754 | 4/1963 | Thompson | 239/523 |
| 3,101,176 | 8/1963 | Goss | 239/523 X |
| 3,109,593 | 11/1963 | Newland, Sr. | 239/524 X |
| 3,335,964 | 8/1967 | Singleton | 239/542 |
| 3,625,434 | 12/1971 | Kitover | 239/289 |
| 3,655,135 | 4/1972 | Altman et al. | 239/521 X |
| 3,782,641 | 1/1974 | Springer | 239/598 |

*Primary Examiner*—Robert W. Saifer

[57] ABSTRACT

A mist generator capable of attachment to a garden hose having a throttling valve for controlling the volume of water discharged and a nozzle including a wedge shaped opening defining an angular surface against which the water discharged will impact to cause the water to break into a mist of tiny droplets having low impact capabilities.

1 Claim, 5 Drawing Figures

FIG. 1.
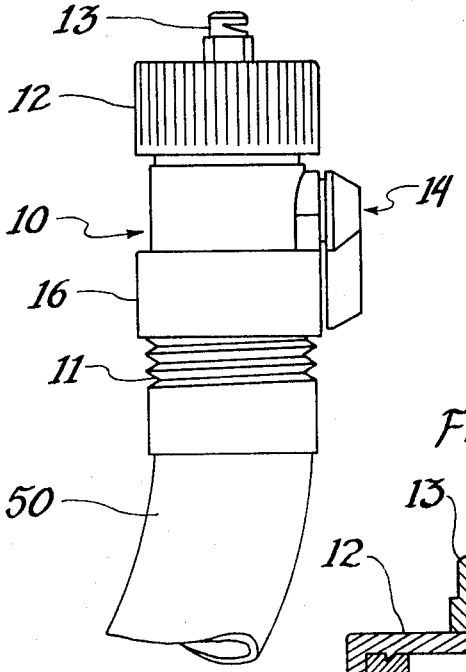
FIG. 2.
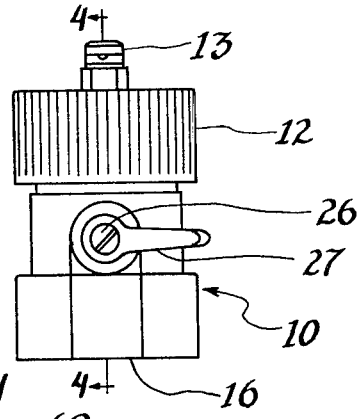
FIG. 4.
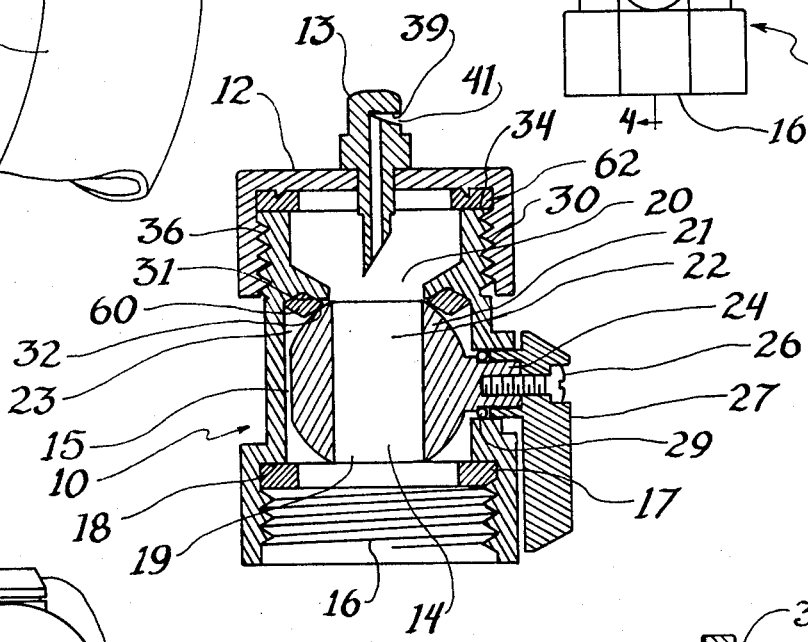
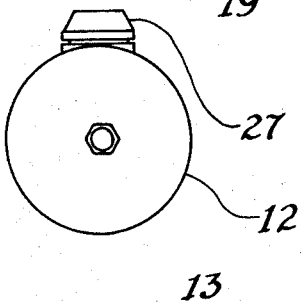
FIG. 3.
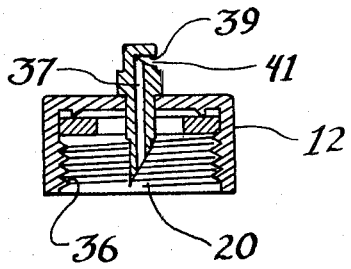
FIG. 5

WATER MIST GENERATOR

BACKGROUND AND SUMMARY OF THE INVENTION

Most hand-held garden hose shut offs currently in use provide a control which permits a selectively variable stream ranging from full stream to a conical spray, as shown in the Rodgers et al U.S. Pat. No. 3,319,893. The intent in these well known controls is to direct the water to a given point in varying degrees of impact. In addition there are numerous fixed sprinkler sprays as shown in Coles et al U.S. Pat. No. 1,954,863, Thompson U.S. Pat. No. 3,085,754, Johnson U.S. Pat. No. 1,766,126, which direct a spray at high velocity from a fixed point over an intended area. The intent of my invention is to produce a controllable cloud of water which delivers little or no impact on the desired surface. The cloud of water consists of a fog or nondirectional droplets. This invention provides an improved misting control having particular utility for maintaining low body temperature while sunbathing. It is a known fact that millions of people sunbathe near lakes, oceans and swimming pools. Upon becoming uncomfortably warm these people cool their bodies by plunging into the water. The need to provide a similar coolant to the millions unable to sunbathe near bodies of water can be seen. The current sprays provide excessive amounts of water at a time when the resource is low in many areas. In addition the force of impact and the excessive volume tends to flush over the skin carrying away sun lotions and oils. This invention produces a fine cloud of water which settles upon a person's body providing the needed coolant through evaporation, thereby allowing the lotions and oils to remain while reducing water usage and maintaining low body skin temperature.

It is, therefore, an object of this invention to provide as means and methods for safely and comfortably sunbathing.

A further object of this invention is a toy for children to play with providing a cooling mist in the summer without danger of high velocity water impacting sensitive areas such as eyes. The reduced water volume discharged by this invention enables children to play for hours in the summer without expending unreasonable amounts of a precious natural resource, water.

A further object is to allow extended play with this invention in a play area and because of its fogging qualities to create less of a muddy mess due to the mist's rapid evaporation.

These and other objects of the present invention, and many of the attendant advantages thereof, will become more readily apparent from a perusal of the following description and the accompanying drawings; wherein:

FIG. 1 is a side elevation view of a sprayer according to the present invention attached to a garden hose for use, FIG. 2 is a front elevaton view of the sprayer shown in FIG. 1 with the valve in the off position, FIG. 3 is top plan view of the end of the sprayer as seen in FIG. 1, FIG. 4 is a sectional view taken on line 4—4 of FIG. 2, with the valve in the ON position and FIG. 5 is a sectional view of the end cap of the sprayer in FIG. 1, showing the positon of the nozzle with the valve assembly eliminated.

DESCRIPTION OF A PREFERRED EMBODIMENT

Referring now to the drawings, there is shown a mist generator, shown generally at 10, which is capable of connection to a standard male fitting 11 on a conventional garden hose 50, as shown in FIG. 1. The mist generator 10 has a removable cap 12 having a nozzle 13 incorporated into its top surface to create a mist of water when water pressure is applied, with the valve 14 in the open position, through the hose 50.

The mist generator 10 has a hollow body 15 adapted to be made of molded plastic, and preferably of a size to be comfortably gripped in the hand. A female end fitting 16 is affixed to or formed in situ with the lower portion of the body 15, and includes internal threads. A washer 17, bearing against an annular shoulder 18, is engaged by the male fitting 11 when it is threaded into the fitting 16 to seal against the washer 17 in the conventional manner. This provides the inlet for pressurized water from the hose 50 to enter the hollow body 15. The valve 14 is positioned within the hollow body 15 thereby defining axially aligned inlet passage 19 and outlet passage 20. Interposed between these passages 19 and 20 is a spherical chamber 23. The valve 14 comprises a ball valve member 21 positioned within the chamber 23 to form a close fit therewith. A flow passage 22 is formed in the member 21 to establish flow between the inlet passage 19 and the outlet passage 20 when the valve 14 is in the open position. The opposite ends of the passage 22 in the member 21 engage the spherical chamber 23 which interrupts the flow between passages 19 and 20, when the valve 14 is moved to its closed position. A stem 24 is detachably connected to the ball valve member 21 and fits through a suitable bearing opening formed in the body 15. The handle 27 is secured to the ball member 21 by means of a screw 26 extending axially through the stem 24 and having a geared interlocking connection with the stem 24. A handle member 27 is used to facilitate turning ball member 21. To seal the connection between the stem 24 and body 15 a compressible sealing ring 29 is positioned adjacent a shoulder formed on the body 15. An "O" ring of common type may be used as the ring 29.

The outlet passage 20 is provided with annular shoulder 31 for sliding engagement with the periphery 32 of the ball valve member 21. A sealing ring 60 of compressible elastic material encircles the member 21 and positioned between shoulder 31 and the member 21. Fluid pressure in the chamber 19 forces the member 21 against the seal 60 to effect a water tight seal there between. The body 15 has external threads 30 allowing threaded attachment to an internally threaded cap 12. A seal is provided by a rubber washer 62 trapped between the cap 12 and the end 34 of the body 15. The cap 12 is held compressed against the washer by the engagement of threads 30 and the internal threads 36 on cap 12.

As shown in FIG. 5, a tubular fluid flow passage 37 of small diameter is provided in the nozzle 13 which is fused into the top portion of the cap 12 allowing liquid to escape from the outlet chamber 20. The passage from the outlet chamber is directed against an angular surface 39, substantially perpendicular to its direction of flow, of a wedge shaped opening 41 in nozzle 13 which opening communicates with the passages 37 to provide an outlet for pressurized water to escape. The escaping water exiting through the fluid flow passage 37 strikes the angular surface 39 causing the water to break into discrete droplets or water mist, which because of their small mass and relatively low velocity individually have low kinetic energy.

While a preferred embodiment of the present invention has been disclosed, it is to be understood that various changes and and modifications may be made without departing from the spirit of the invention as defined by the scope of the appended claims.

What is claimed is:

1. A mist generator comprising:

a hollow body having a female end fitting on one end for connection with a garden hose and external threads on the other end;

a hollow cap having internal threads complementary to and engageable with said external threads;

said hollow cap having an unobstructed flat upper surface;

a rotatable valve positioned within said body and moveable between an open position in which flow of water is permitted through said body and a closed position in which said flow is blocked;

a nozzle mounted in said cap projecting above said surface and having a wedge shaped opening defining an upper surface and a lower surface diverging downward and outward;

a tubular passage of small diameter in said nozzle providing communication between said hollow body and said wedge shaped opening;

the upper surface being oriented substantially perpendicular to said tubular passage whereby the flow of water through said tubular passage will impact said upper surface to create a freely dispersible mist of tiny discrete droplets having low kinetic energy.

* * * * *